US006736525B2

(12) United States Patent
Chin

(10) Patent No.: US 6,736,525 B2
(45) Date of Patent: May 18, 2004

(54) ENERGY EFFICIENT TUBULAR LIGHT

(75) Inventor: Yuan-Cheng Chin, Hsintien (TW)

(73) Assignee: Unity Opto Technology Co., Ltd., Taipei Hsien (TW)

( * ) Notice: Subject to any disclaimer, the term of this patent is extended or adjusted under 35 U.S.C. 154(b) by 64 days.

(21) Appl. No.: 10/142,793

(22) Filed: May 13, 2002

(65) Prior Publication Data

US 2003/0210546 A1 Nov. 13, 2003

(51) Int. Cl.[7] ..... F21V 21/00
(52) U.S. Cl. ..... 362/249; 368/217; 368/457
(58) Field of Search ..... 362/217, 227, 362/231, 240, 310, 311, 249, 351, 361, 457

(56) References Cited

U.S. PATENT DOCUMENTS 5,103,382 A * 4/1992 Kondo et al. ..... 362/503
5,607,227 A * 3/1997 Yasumoto et al. ..... 362/249
6,361,186 B1 * 3/2002 Slayden ..... 362/249

* cited by examiner

*Primary Examiner*—Sandra O'Shea
*Assistant Examiner*—Ali Alavi
(74) *Attorney, Agent, or Firm*—Bacon & Thomas

(57) ABSTRACT

A tubular light includes a light set having a substrate with light emitting diodes mounted on the substrate so as to electrically connect to the substrate, a tubular cover made of a translucent material, the tubular cover having a receiving space defined therein, a positioning seat formed to securely receiving the substrate in the receiving space, and a securing device securely engaged with the tubular cover and adapted to securely engage to a surface.

4 Claims, 6 Drawing Sheets

ENERGY EFFICIENT TUBULAR LIGHT

BACKGROUND OF THE INVENTION

1. Field of the Invention

The present invention relates to a tubular light, and more particularly to an energy efficient tubular light. The tubular light has multiple light emitting diodes (LED) respectively and securely mounted on a substrate which then is secured to a surface. A cover made of a translucent material is provided to enclose the LEDs. With such an arrangement, the energy consumption of the light is low and the maintenance thereof is easy.

2. Description of Related Art

For many years, the neonlight has been used in different fields to enhance commercial activities due to its special visual effect. A conventional neonlight is shown in FIG. 7, wherein the neonlight has a cover (9), a frame (91), at least one seat (92) and a related circuit (not shown). The seat (92) has a neonlight tube (93) securely mounted thereon and having an electrical conductive coating (931) coated on an outer periphery of the neonlight tube (93). When the neonlight is connected to a power source, the coating (931) is charged so that the inert gas inside the neonlight tube (93) reacts with a fluorescent power applied on an inner periphery of the neonlight tube (93) to emit light. Because the principle of how the neonlight works is conventional in the art and is well known to a person skilled in the art so that further discussion thereof is omitted.

However, this conventional neonlight consumes a lot of energy, which is quite a waste especially when the current energy shortage is taken into consideration. The neonlight takes a lot of space and is heavy. Therefore, when mounting the neonlight, a reinforced structure is necessary to ensure the neonlight is accurately positioned. Still, if the reinforced structure is applied, the cost for the entire neonlight is increased and also the maintenance thereof is difficult.

To overcome the shortcomings, the present invention intends to provide an improved energy efficient tubular light to mitigate or obviate the aforementioned problems.

SUMMARY OF THE INVENTION

The primary objective of the invention is to provide an improved energy efficient light using LEDs as the light source so that the energy consumption is dramatically reduced.

Another objective of the invention is to provide a securing device which is able to secure the LEDs on a surface and still remains the maintenance and cost of the tubular light easy and low.

Other objects, advantages and novel features of the invention will become more apparent from the following detailed description when taken in conjunction with the accompanying drawings.

DETAILED DESCRIPTION OF PREFERRED EMBODIMENT

Figure 1:
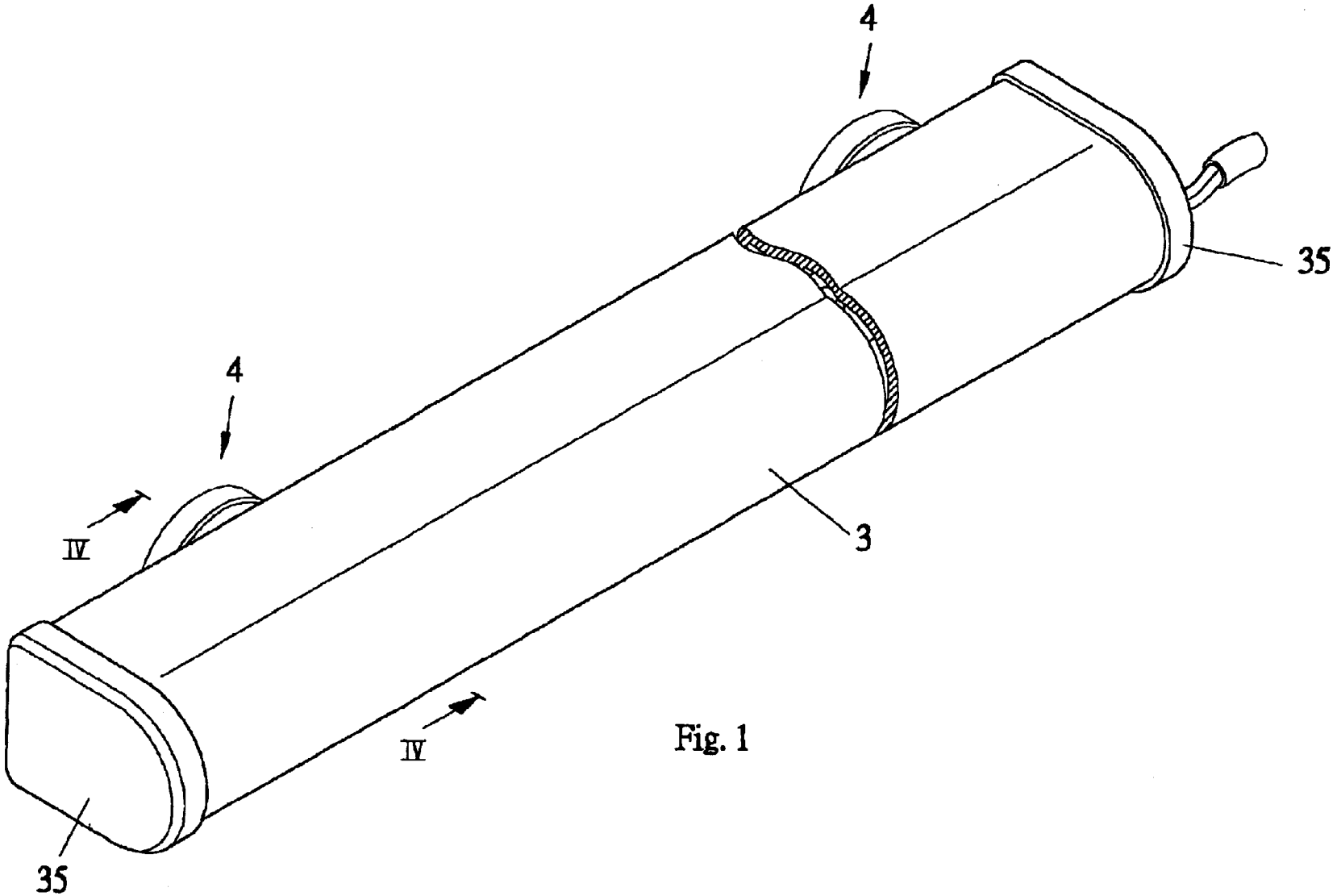
FIG. 1 is a perspective view of a tubular light of the present invention.
Figure 2:
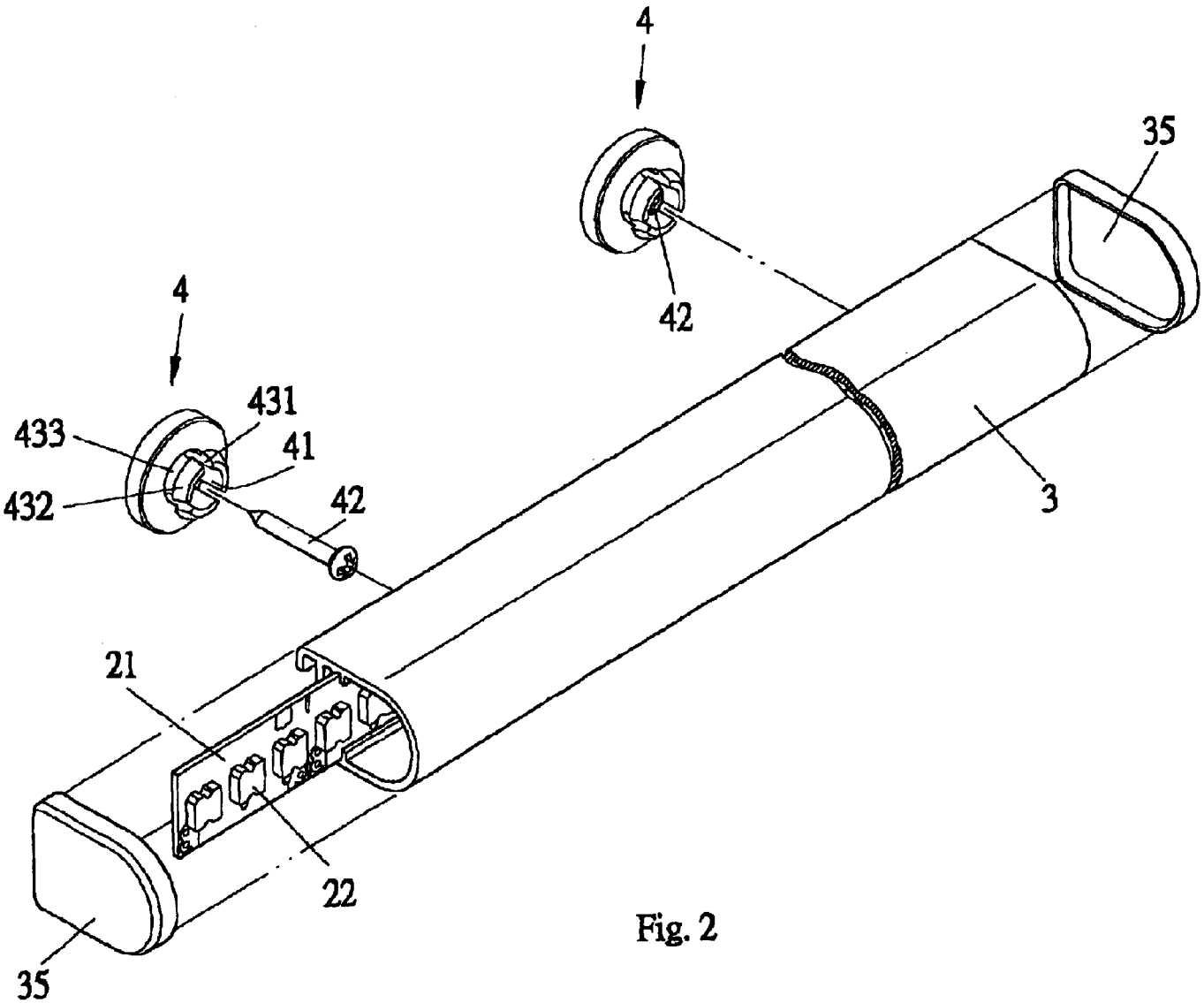
FIG. 2 is an exploded perspective view of the tubular light in FIG. 1, wherein the securing device is moved away from the cover for clarity.

With reference to FIGS. 1 and 2, the tubular light constructed in accordance with the present invention has a light set (2), a cover (3) and a securing device (4).

The light set (2) has a substrate (21) and multiple light emitting diodes (22) securely mounted on the substrate (21). In this embodiment, the substrate (21) may be a circuit board so that after the LEDs (22) are mounted on the substrate (21) and the substrate (21) is connected to a power source, the LEDs (22) are lit.

Figure 3:
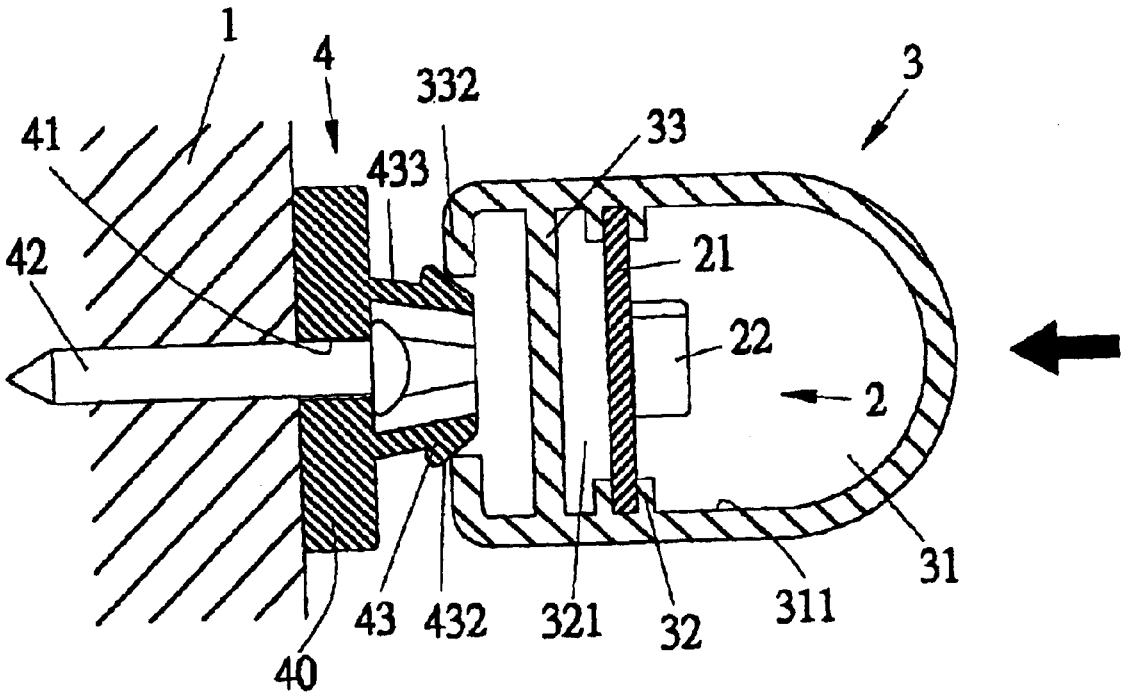
FIG. 3 is a cross sectional view showing the relationship of the cover with the light set received therein and the securing device.

The cover (3) is made of a translucent material and defines therein a receiving space (31), as shown in FIG. 3, a positioning seat (32) mounted on opposite inner periphery (311) of the cover (3). As shown in this embodiment, the positioning seat (32) is composed of two pairs of projecting blocks (not numbered). Every pair of projecting blocks has a central gap (321) defined therebetween to correspond to the substrate (21) so that the substrate (21) is able to be positioned in the gap (321) and in the cover (3). The cover (3) further has a baffle (33) provided adjacent to the two pairs of projecting blocks and inside the cover (3). Two distal ends of the baffle (33) extends out therefrom and toward each other to form a hook (332). Two distal ends of the cover (3) is encased by a lid (35).

The securing device (4) has a body (40), a through hole (41) defined in a center of the body (40), a securing element (42) extendable through the through hole (41) and a pair of oppositely formed extensions (43) each provided with a barb (432) at the free end of the extension (43) and a neck (433) formed between the barb (432) and the body (40). The two extensions (43) are formed on opposite sides of the through hole (41) so as to sandwich the through hole (41).

Figure 4:
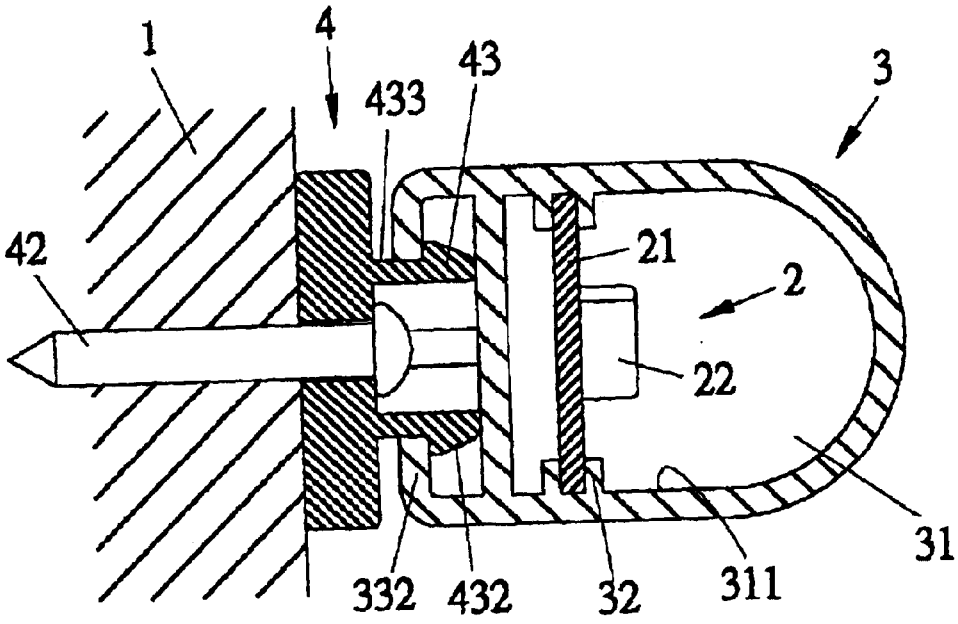
FIG. 4 is a cross sectional view showing that the cover is engaged with the securing device so as to secure the tubular light on a surface.

When the tubular light of the present invention is to be assembled, with reference to FIG. 3, the light emitting diodes (22) are mounted on the substrate (21) in parallel and then the substrate (21) is positioned between two gaps (321) inside the cover (3). Thereafter, the securing element (42) extends through the through hole (41) and into a surface of a building (1) to fix the securing device (4) in place. After the securing device (4) is in place and the assembly between the light set (2) and the cover (3) is finished, the cover (3) is moved toward the securing device (4) with the two hooks (332) corresponding to the two barbs (432). When the two barbs (432) engage the two corresponding hooks (332), the two barbs (432) are forced to moved toward each other due to the width of the two barbs (432) with the through hole (41) being larger than that of the two hooks (332). However, after the two barbs (432) extend through the space between two hooks (332), the two barbs (432) return to their original positions so that the two hooks (332) are positioned at the necks (433) to securely connect the cover (3) with the light set (2) therein to the securing device (4), as shown in FIG. 4.

When the tubular light of the present invention is in use, the energy consumption is drop to 9% when compared to the energy consumption of the conventional neonlight. When compared to the conventional fluorescent light, the energy consumption of the tubular light of the present invention is even drop to 6%. Therefore, the tubular light of the present invention is energy efficient and economic.

The light emitting diode is light weight and takes small space so that the positioning of the light emitting diode on the substrate is easy and cost effective.

Figure 5:
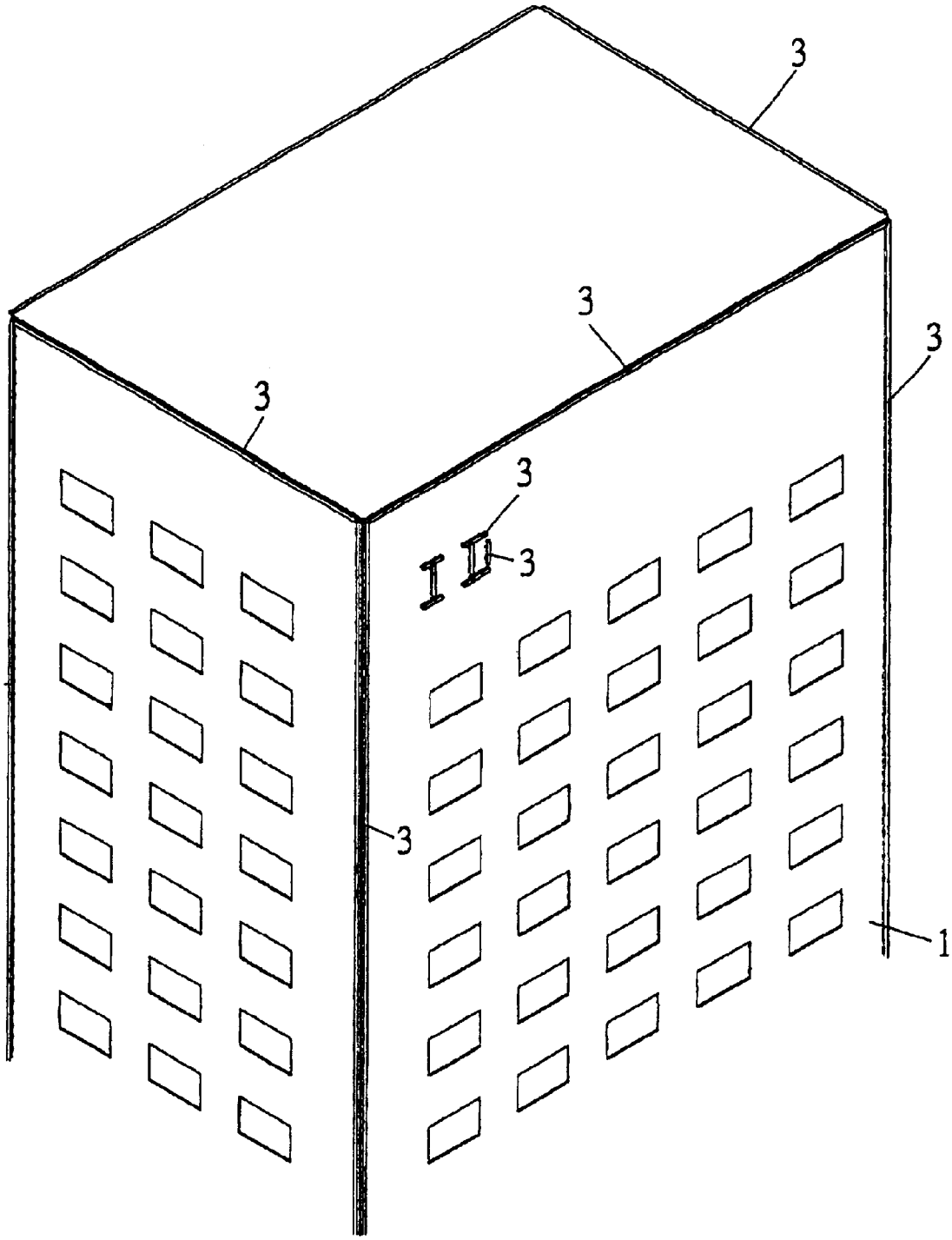
FIG. 5 is a perspective view showing an application of the tubular light of the present invention.

With reference to FIG. 5, the tubular light is able to be mounted on edges of a building (1) and uses multiple colors of the light beams from the LEDs (22) to show glamorous visual effects.

Figure 6:
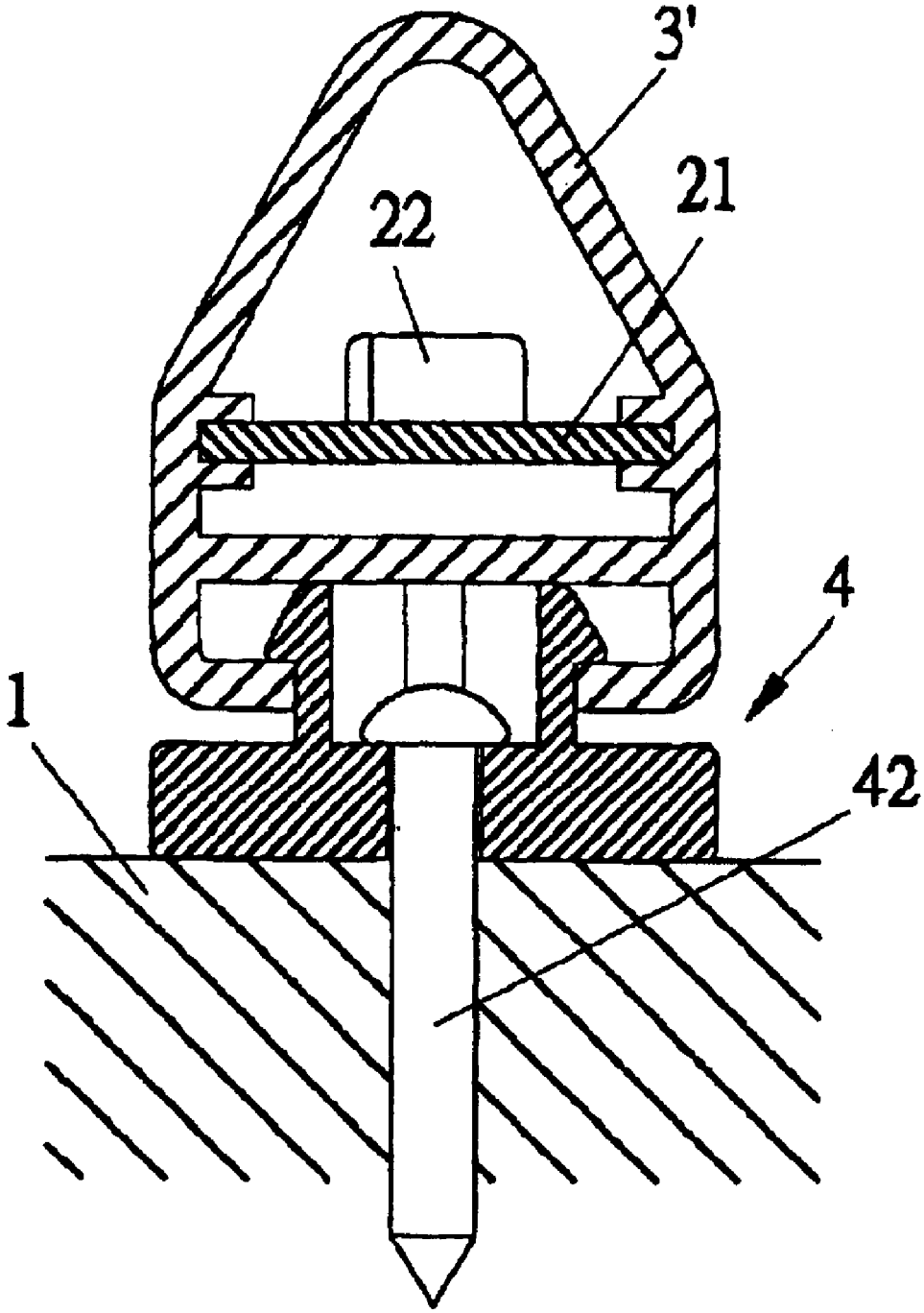
FIG. 6 is a cross sectional view of another embodiment of the tubular light of the present invention.
Figure 7:
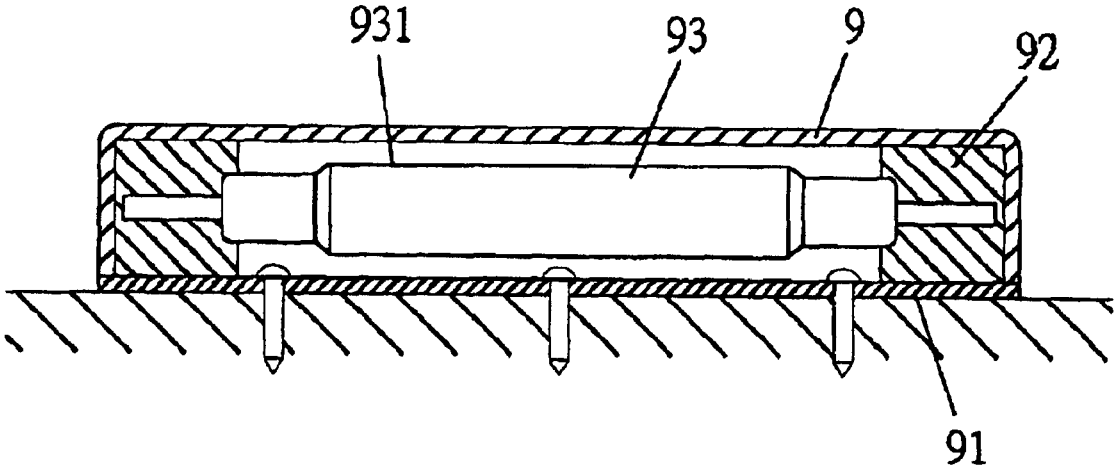
Fig. 7 (Prior Art)
FIG. 7 is a schematic view showing a conventional tubular light.

With reference to FIG. 6, the cover 3A is made triangular in cross section to mate with different requirements.

It is concluded that the tubular light of the present invention is easy to proceed the maintenance and a diffuser may be added to the cover (3) when being injection molded so that the cover (3) has even light distribution effect.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

It is claimed:

1. A tubular light comprising:

a light set having a substrate with light emitting diodes mounted on the substrate so as to electrically connect to the substrate;

a tubular cover made of a translucent material, the tubular cover having a receiving space defined therein, a positioning seat formed on opposite inner faces of the cover and composed of two pairs of projecting blocks, each pair of projecting blocks having a gap defined therebetween to correspond to the substrate so that the substrate is able to be positioned in the receiving space of the cover, a baffle provided adjacent to the two pairs of projecting blocks and having two distal ends each extending out to form a hook; and a securing device having a body, a through hole defined in a center of the body, a securing element extendable through the through hole to adapt to securely engage the body to a surface, a pair of extensions oppositely formed beside the through hole so as to sandwich the through hole therebetween, each extension provided with a barb at a free end of the extension to correspond to the hooks and a neck formed between the barb and the body to receive a corresponding one of the hooks so as to securely engage the cover with the light set therein to the body.

2. The tubular light as claimed in claim 1, wherein the light emitting diodes are arranged on the substrate in parallel.

3. The tubular light as claimed in claim 2, two distal ends of the cover is respectively encased by a lid.

4. The tubular light as claimed in claim 1, a diffuser is added to the cover so that the cover is able to emit light evenly.

* * * * *